US006089865A

United States Patent [19]

Edgar

[11] Patent Number: 6,089,865

[45] **Date of Patent: *Jul. 18, 2000**

[54] TONGUE CLEANING DEVICE

[76] Inventor: Gary W Edgar, 5591 N. Barrasca Ave., Tucson, Ariz. 85750

[ * ] Notice: Under 35 U.S.C. 154(b), the term of this patent shall be extended for 503 days.

[21] Appl. No.: 08/747,663

[22] Filed: Nov. 13, 1996

Related U.S. Application Data

[63] Continuation-in-part of application No. 08/400,829, Mar. 8, 1995, abandoned.

[51] Int. Cl.[7] ..... A61G 17/02

[52] U.S. Cl. ..... 433/89; 433/80; 601/165

[58] Field of Search ..... 433/80, 89, 88; 401/289; 604/93, 289; 601/162, 163, 165; 222/402.13; 15/28, 29

[56] References Cited

U.S. PATENT DOCUMENTS

| | | | |
|---|---|---|---|
| 4,863,302 | 9/1989 | Herzfeld et al. | 401/289 |
| 5,098,291 | 3/1992 | Curtis et al. | 433/89 |
| 5,208,933 | 5/1993 | Lustig et al. | 15/22.1 |
| 5,226,197 | 7/1993 | Nack et al. | 15/111 |
| 5,484,281 | 1/1996 | Renow et al. | 433/80 |

*Primary Examiner*—Wynn Wood Coggins
*Assistant Examiner*—David J. Cho
*Attorney, Agent, or Firm*—Eugene R. LaRoche

[57] ABSTRACT

A device for applying cleaning and/or irrigating liquid directly to the base of the tongue includes a plurality of rigid mechanical fingers which gently part the taste buds when they are moved across the surface of the tongue. The fingers have openings in the ends through which liquid passes while the taste buds are parted whereby the liquid is applied directly to the portion of the tongue under the taste buds. The device is connected to a source of liquid which may be a liquid reservoir or a pulsating water irrigation system. The device may take the form of a hollow unitary structure of high impact injection molded plastic. A tongue scraper blade may be attached to the device.

18 Claims, 2 Drawing Sheets

TONGUE CLEANING DEVICE

CROSS REFERENCE TO RELATED APPLICATIONS

This application is a continuation-in-part of application Ser. No. 08/400,829, filed Mar. 8, 1995 now abandoned.

BACKGROUND AND SUMMARY OF THE INVENTION

It is common knowledge in the field of oral hygiene that minute food particles, bacteria, and cellular debris tend to collect on the surface of the tongue. If the tongue is not kept clean of the food particles, bacteria, and debris, a bad odor in the breath may be created and infections on the tongue may develop. To combat these problems it is desirable to both clean the tongue and to introduce medication or mouthrinse directly on the tongue. Currently, mechanical tongue scrapers are available which use a blade to scrape the tongue's surface and numerous spray devices can be found to spray medication or mouthrinse on the tongue. However, none of the known devices or methods are truly effective at cleaning the tongue or applying medication or mouthrinse to the tongue because they fail to recognize or deal with problems caused by the unique structure of the tongue.

Much of the surface of the tongue is covered with taste buds which protrude from the tongue. Bacteria, minute food particles, and cellular debris tend to accumulate on the surface of the tongue under the taste buds. Conventional methods of cleaning the tongue or applying medication or mouthrinse to the tongue are not effective in dealing with the area of the tongue surface under the taste buds. A mechanical tongue scraper merely scrapes the surface of the taste buds and does not reach the material under the taste buds. When medication or mouthrinse is sprayed on or swirled over the tongue, the taste buds shield the surface of the tongue under them preventing much of the medication or mouthrinse from reaching the surface. Clearly, there is a need in the oral hygiene field for a device which effectively cleans the tongue surface under the taste buds and can effectively apply medication or mouthrinse directly to the tongue surface under the taste buds.

It is an object of the present invention to provide an oral hygiene device for effectively cleaning the surface of the tongue, including that part of the tongue surface which underlies the taste buds.

It is another object of the invention to provide an oral hygiene device for applying medication or mouthrinse directly onto the surface of the tongue, including that part of the tongue surface, called the floor of the tongue, which underlies the taste buds.

It is a further object of the invention to provide a tongue cleaning/irrigating device which will gently part the tops of the taste buds while simultaneously applying a liquid, such as water, mouthrinse, or medication, onto the tongue surface under the taste buds.

It is a further object of the invention to provide a tongue cleaning/irrigating device which can be used to gently part the tops of the taste buds in order to flush food particles, bacteria, and cellular debris from the floor of the tongue.

It is a further object of the invention to provide a tongue cleaning/irrigating device which can be used to gently part the tops of the taste buds in order to introduce oxidizing, deodorizing mouthrinse between the parted taste buds onto the tongue surface to neutralize acidic by-products of bacterial colonies.

It is a further object of the invention to provide a tongue cleaning/irrigating device which can be used to gently part the tops of the taste buds in order to introduce medicated tissue conditioners to treat infections and irritations on and under the surface of the tongue.

The objects of the invention are achieved by the tongue cleaning/irrigating device of the present invention which gently parts the tops of the taste buds while simultaneously introducing a liquid between the taste buds onto the floor of the tongue. Preferably, a plurality of rigid mechanical fingers part the taste buds while liquid is applied to the floor of the tongue through openings in the ends of the fingers. Preferably, the liquid is introduced under pressure. The device of the present invention may include a provision for attachment to a pulsating water irrigator or may include a refillable squeezable bulb or the like. The device of the invention may further include a blade portion which can be used as a conventional tongue scraper.

Other objects, advantages and novel features of the present invention will become apparent from the following detailed description of the invention when considered in conjunction with the accompanying drawings.

DETAILED DESCRIPTION OF THE INVENTION

Figure 2:
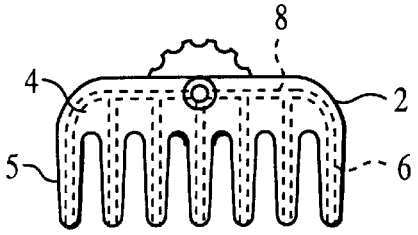
FIGS. 1–4 show an isometric view, a top view, a front view, and a side view, respectively, of a first embodiment of the invention in which the device is adapted for connection to a pulsating water irrigator.
Figure 1:
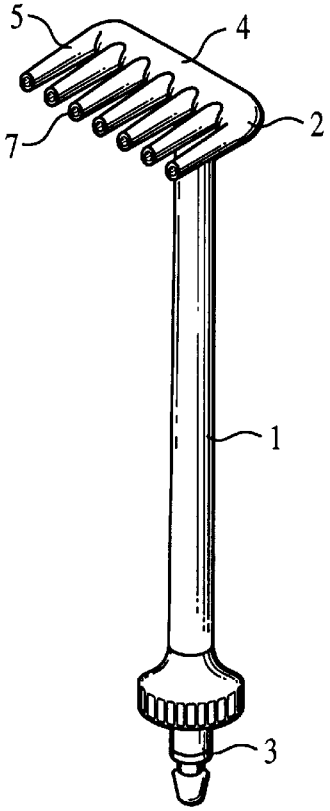
Figure 3:
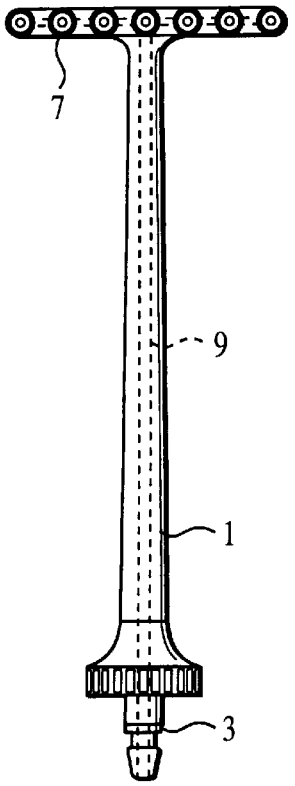
Figure 4:
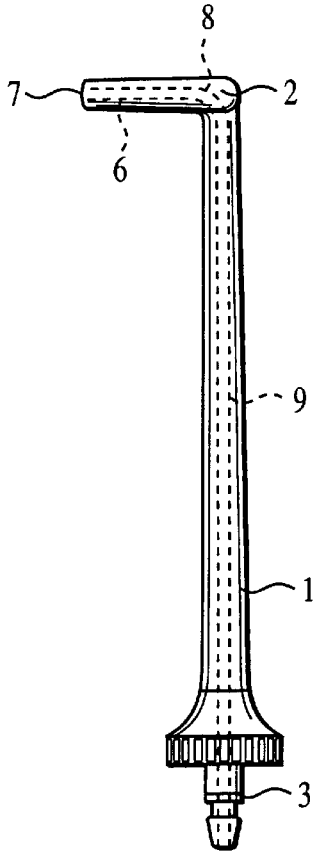

Referring to FIGS. 1–4 of the drawings, the tongue cleaning/irrigating device of the present invention comprises a tubular portion 1 connected at one end to a head portion 2 and at the other end to a connector 3. Head portion 2 comprises a base portion 4 and a plurality of rigid fingers 5 extending therefrom. Each of the fingers has a channel or passage 6 through which liquid can flow. One end of each finger 5 has an opening 7 through which liquid from passage 6 can exit the head portion. Base portion 4 has a passage 8 which is connected to each of the passages 6 of the fingers. Tubular portion 1 serves as a means for connecting head portion 2 to a source of liquid as well as a convenient place for the user to grip the device. Tubular portion 1 has a liquid passage 9 which extends through connector 3 at one end and is connected to passage 8 at the other end. Although described above in terms of functional portions, the device preferably comprises a unitary structure made of high impact injection molded plastic of the type approved for use in health industry products. The connector 3 as shown in the Figs. is a conventional snap-on connector used in most pulsating water irrigation systems. This allows the device of the present invention to be used as an accessory in or with pulsating water irrigation systems already on the commercial market. However, the exact structure of the connector is not critical and is determined by the need to match the connector of the particular pulsating water irrigation system or other liquid supply system with which the device is intended to operate.

In operation, the device of FIGS. 1–4 is connected to a source of liquid (not shown), such as a conventional pulsating water irrigator, by means of connector 3. The user holds tubular member 1 of the device in his/her hand, inserts the head portion 2 into the mouth, and places the ends of fingers 5 onto the tongue. When the source of liquid is turned on, the liquid flows through passages 9, 8, and 6 and out of the head through openings 7 in fingers 5. The user slowly and gently moves the device over the surface of the tongue. As the device is moved over the tongue, the ends of rigid fingers 5 gently part the tops of the taste buds allowing the liquid which is flowing through openings 7 to reach the base of the tongue. The liquid can be water, mouthrinse, medicated tissue conditioners or any other solution useful in cleaning or treating the surface of the tongue.

Fingers 5 must be long enough to part the tops of the taste buds. The ends of the fingers are shaped so as to feel comfortable on and not scratch or irritate the tongue. In the preferred embodiment, the ends of the fingers are rounded. The diameter or cross section of the fingers is sufficiently small so that the fingers can easily and comfortably fit between the taste buds. The size of the openings 7 in the fingers is large enough to allow a semi-viscous solution to be forced through with moderate pressure but not so large as to deter deflection of the taste buds.

Figure 5:
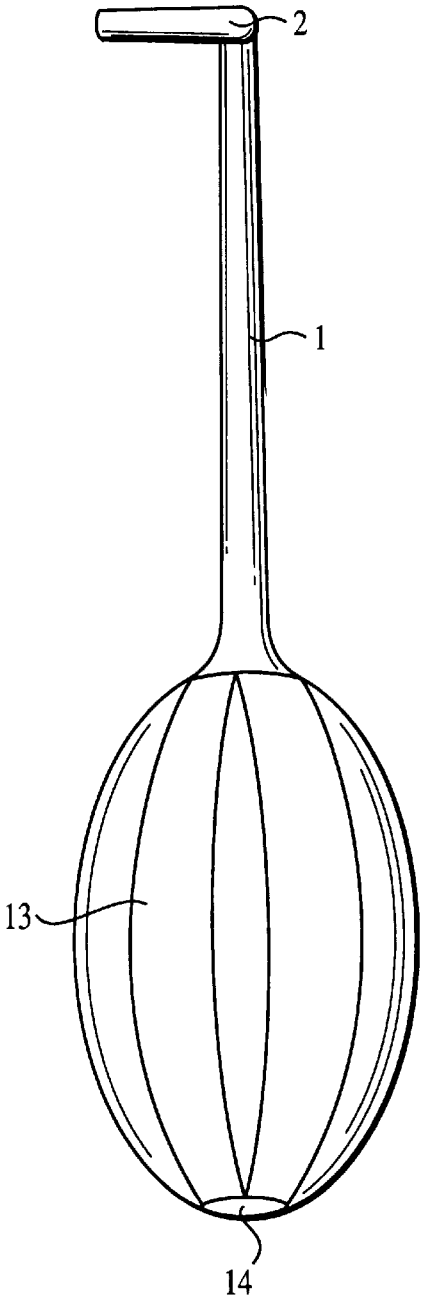
FIG. 5 shows a second embodiment of the invention in which a squeezable bulb is attached to the device to provide the source of the liquid. Except for the source of the liquid, this embodiment is similar in all respects to the first embodiment.

The device shown in FIG. 5 is identical to the embodiment of FIGS. 1–4 except that the connector 3 of the previously described embodiment is not used to supply liquid to the device. In the embodiment of FIG. 5, a squeezable bulb 13 is attached to the end of tubular member 1 to serve as a liquid reservoir to supply the liquid for cleaning, irrigation and/or medication. The bulb is preferably constructed of a flexible, accordion shaped plastic material that is durable enough to remain operable after repeated usage but does not require a great deal of pressure to squeeze and thus can be operated with one hand. Preferably, the squeezable bulb 13 is permanently attached to the tubular portion 1 and has a snap-open cap 14 to allow for refilling of the bulb with liquid. This embodiment is advantageous because it is a complete unit in itself and because it allows users who don't have an irrigating unit to manually squeeze the desired solutions onto the floor of the tongue.

Figure 6:
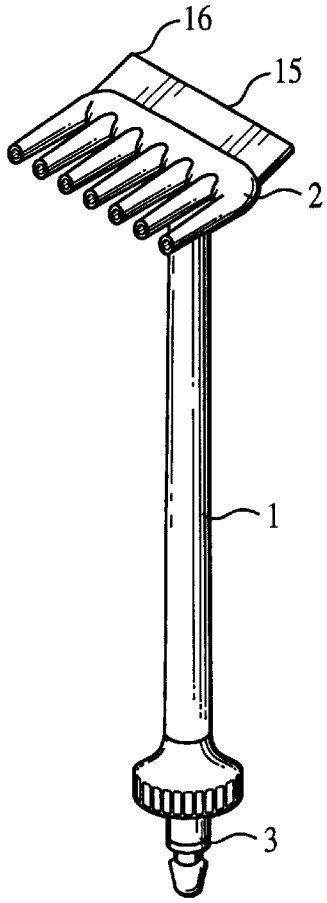
FIG. 6 shows the device of the invention with a scraper blade attached.

FIG. 6 shows the device of the invention with a scraper blade added. Except for the blade, the device is identical to the embodiment described in reference to FIGS. 1–4. Scraper blade 15 is preferably attached to the back of head portion 2. The scraper blade 15 is rounded at edges 16 to decrease the possibility of scratching or irritating the tongue during use. Otherwise, the structure of the blade is conventional. The scraper can be used to scrape away surface film and debris before and/or after irrigating the tongue or can be used even if the tongue is not irrigated.

Although the present invention has been described and illustrated in detail, it is to be clearly understood that the same is by way of illustration and example only, and is not intended to be taken by way of limitation. The spirit and scope of the present invention are to be limited only by the terms of the appended claims.

I claim:

1. A device for treating a tongue, said tongue having a surface and taste buds covering at least a part of said surface, comprising:

a head portion;

means for connecting said head portion to a source of liquid;

said head portion including means for parting the taste buds of the tongue while applying liquid received from said source through said connecting means directly to the surface of the tongue, wherein said head portion includes a base portion and said means for parting the taste buds while applying liquid comprises a plurality of rigid fingers extending from said base portion.

2. The device according to claim 1 wherein said connecting means includes a tubular portion having a first end and a second end, the first end being connected to said base portion and the second end being adapted to be connected to a source of liquid.

3. The device according to claim 2 wherein said second end of said tubular portion includes a connector.

4. The device according to claim 3 wherein said connector, said tubular portion, said base portion, and said plurality of fingers comprise a single unitary structure.

5. The device according to claim 4 wherein said fingers have openings and each finger has a passage for liquid, and a passage for liquid extends from the connector through the tubular portion and the base portion to the passage in each finger so that liquid entering the connector will flow through the tubular portion and the base portion to and through each finger and out through the openings.

6. The device according to claim 4 wherein said single unitary structure is comprised of plastic material.

7. The device according to claim 1 further including a tongue scraper extending from said head portion.

8. The device according to claim 2 wherein said second end of said tubular portion is connected to a liquid reservoir.

9. The device according to claim 8 wherein said liquid reservoir comprises a squeezable bulb.

10. The device according to claim 9 wherein squeezable bulb includes a removable cap whereby said bulb can be refilled with liquid when the cap is removed.

11. The device according to claim 8 wherein said liquid reservoir is permanently attached to said second end of said tubular portion.

12. An oral hygiene device for cleaning and/or irrigating a tongue, comprising:

a unitary hollow plastic structure having at one end a plurality of rigid fingers which are shaped and sized for movement across the tongue, the fingers having openings where the fingers come into contact with the tongue; and, means for connecting the fingers to a source of liquid so that, during use of the device, liquid flows through the hollow plastic structure and out of the openings in the fingers and is applied to the tongue.

13. The device of claim 12 further including means for connection to a source of pulsating liquid, said means for connection comprising a snap-on connector.

14. The device of claim 13 wherein the connector is an integral part of the unitary hollow plastic structure.

15. The device of claim 12 further including a liquid reservoir connected to said connecting means.

16. The device of claim 12 wherein said tongue has a surface and taste buds covering at least a part of said surface and the shape and size of the fingers is such that movement of the fingers across the tongue parts the taste buds.

17. The device of claim 15 wherein the liquid reservoir comprises a squeezable bulb which has an opening and a removable cap on the opening to allow filling and refilling of the bulb with liquid.

18. The device of claim 12 further including a scraper blade attached at said one end.

* * * * *